United States Patent [19]

Ogasa

[11] Patent Number: 4,877,993

[45] Date of Patent: Oct. 31, 1989

[54] INLINE TYPE COLOR PICTURE TUBE HAVING COMA DISTORTION CORRECTING MECHANISM

[75] Inventor: Takaaki Ogasa, Mobara, Japan

[73] Assignee: Hitachi, Ltd., Tokyo, Japan

[21] Appl. No.: 157,793

[22] Filed: Feb. 19, 1988

[30] Foreign Application Priority Data

Mar. 20, 1987 [JP] Japan ..... 62-63786

[51] Int. Cl.[4] ..... H01J 29/51

[52] U.S. Cl. ..... 313/414; 313/412; 313/413; 313/431

[58] Field of Search ..... 313/412, 413, 414, 431, 313/437

[56] References Cited

U.S. PATENT DOCUMENTS

| | | | |
|---|---|---|---|
| 3,873,879 | 3/1975 | Hughes | 313/414 X |
| 4,196,370 | 4/1980 | Hughes | 313/413 |
| 4,225,804 | 9/1980 | Bekaert et al. | 313/431 X |
| 4,547,697 | 10/1985 | Burdick et al. | 313/414 X |

FOREIGN PATENT DOCUMENTS

| | | | |
|---|---|---|---|
| 137261 | 11/1977 | Japan . | |
| 0046557 | 3/1983 | Japan | 313/414 |
| 0179038 | 8/1986 | Japan | 313/412 |

*Primary Examiner*—Donald J. Yusko
*Assistant Examiner*—Michael Horabik
*Attorney, Agent, or Firm*—Antonelli, Terry & Wands

[57] ABSTRACT

The present invention relates to an inline type color picture tube having a coma distortion correcting mechanism in electron guns. A shield cup is attached to the tips of the electron guns. Three electron beam through-holes are formed in the shield cup in the inline direction. Ring-shaped magnetic material members are arranged around the two outside electron beam through-holes among those three through-holes. This magnetic material member is made of a material of a high permeability. Further, each ring-shaped magnetic material has a gap portion on the side opposite to the central electron beam through-hole. The gap portions of the ring-shaped magnetic materials arranged around both of the outside through-holes have shapes which are symmetrical in the lateral direction around the central electron beam through-hole as a center.

3 Claims, 3 Drawing Sheets

INLINE TYPE COLOR PICTURE TUBE HAVING COMA DISTORTION CORRECTING MECHANISM

BACKGROUND OF THE INVENTION

The present invention relates to an inline type color picture tube in which a coma distortion correcting mechanism to make a central electron beam and a pair of outside electron beams accurately coincide on a fluorescent screen and to eliminate a coma distortion is provided in electron guns.

In general, in what is called an inline type color picture tube in which three electron guns for generating three electron beams for red, green, and blue are arranged in a line in the horizontal direction, the magnetic field generated by a vertical deflecting coil is formed like a barrel as shown in FIG. 1 and the magnetic field generated by a horizontal coil is formed like a pincushion shape as shown in FIG. 2, so that rasters as shown in FIG. 3 can be obtained on the screen of a color picture tube. Namely, in FIGS. 1 and 2, reference numerals 1, 2, and 3 denote red, green, and blue electron beams; 4 indicates a barrel magnetic field; 5 a pincushion magnetic field. By adjusting deflecting amounts of the electron beams 1 and 3 on both sides, rasters of both of these electron beams, i.e., a red raster 6 and a blue raster 7 can be made to coincide as shown in FIG. 3. However, a deflecting amount of the central electron beam, i.e., the green electron beam 2 is slightly different from those of the electron beams on both sides. Therefore, a green raster 8 is formed in the inside or outside of the red raster 6 and blue raster 7. In FIG. 3, the case where the red raster 6 and blue raster 7 are formed in the inside of the green raster 8 is called a green narrow (N). Similarly, the case where they are formed in the outside of the green raster 8 is called a green wide (W). To make the green raster 8 coincide with the red raster 6 and blue raster 7, in general, hitherto, two kinds of magnetic material members 9 and 10 having different shapes for correction as shown in, e.g., FIG. 4 are arranged at electron beam emitting ends of the electron guns, thereby correcting a coma distortion.

For example, a magnetic material element to correct a coma distortion is disclosed in, for example, JP-B-No. 61-17094 filed in Japan by Toshiba Corporation on May 12, 1976, U.S. co-pending application Ser. No. 12,997 filed in the U.S.A. on Feb. 10, 1987 by ISHIBASHI et al of the same assignee as the present application, or U.S. Pat. No. 3,873,879 assigned to Hughes.

This magnetic material element tends to give a shielding effect to vertical and horizontal leakage magnetic fields 11 and 12 to the side of the electron guns of the deflecting coils. By changing the deflecting effects of the leakage magnetic fields to the red and blue electron beams (outer beams) and to the green electron beam (inner beam), those electron beams can be made to coincide on the screen.

However, the sizes and arranging positions of the two kinds of magnetic material elements having different sizes are not unconditionally determined by the magnitudes of the leakage magnetic fields or the sizes of the deflecting coils. It cannot help finding out the optimum combination by trial and error by preparing a plurality of combinations of several kinds of magnetic material elements of different sizes. Therefore, it takes a long time to determine the sizes and positions of two magnetic materials for obtaining the best coma distortion correcting effect.

SUMMARY OF THE INVENTION

It is an object of the present invention to provide a color picture tube apparatus having a coma distortion correcting mechanism which can correct a coma distortion with high accuracy by one kind of magnetic material element without needing a combination of different magnetic material elements.

In the coma distortion correcting mechanism according to a color picture tube apparatus of the present invention, arc-shaped flat plates made of magnetic materials each having a high relative permeability are axially symmetrically fixed and arranged in the peripheral portion of through-holes of the outside electron beams in a shield cup and at the same time, gap portions are formed in the outside of the magnetic materials.

The arc-shaped flat plates in the invention weaken the leakage magnetic fields which traverse the outside electron beams and increase the leakage magnetic fields which traverse the central electron beam, so that the central electron beam and the outside electron beams are substantially made to coincide on a fluorescent surface.

DESCRIPTION OF THE PREFERRED EMBODIMENT

Figure 1:
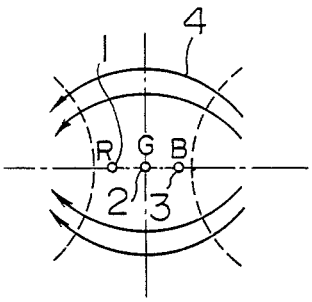
FIGS. 1 and 2 are diagrams showing states of vertical and horizontal deflecting magnetic fields.
Figure 2:
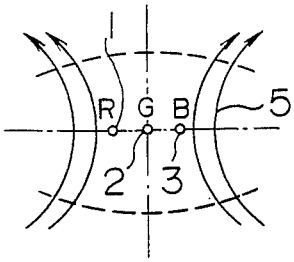
Figure 3:
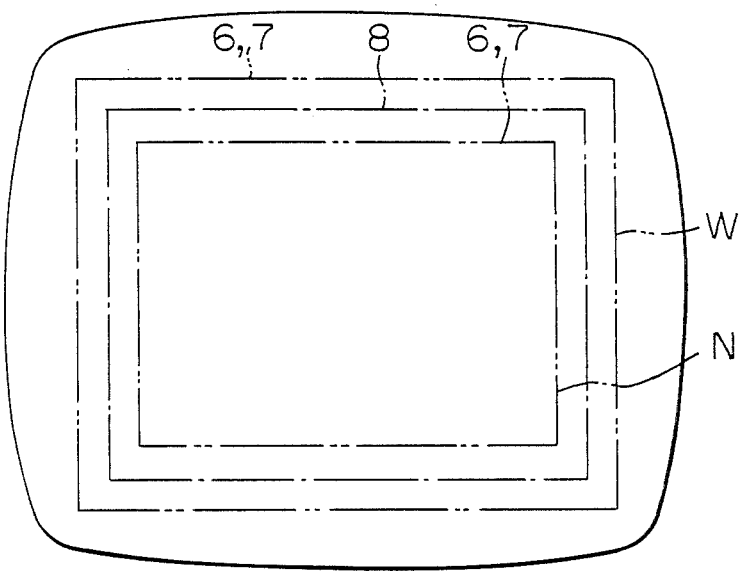
FIG. 3 is a diagram showing rasters on a screen when a coma distortion occurred.
Figure 4:
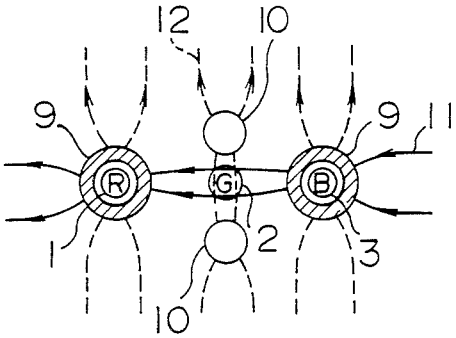
FIG. 4 is a diagram showing a state of leakage magnetic fields and electron beams.
Figure 5:
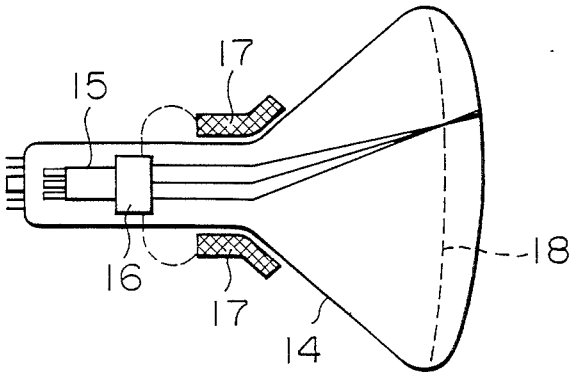
FIG. 5 is a diagram showing a whole inline type color picture tube.

FIG. 5 is a diagram when an inline type color picture tube to which the present invention is applied is seen in the lateral direction. Electron guns 15 to generate three electron beams, a shield cup 16 attached to the edges of the electron guns 15, a deflecting coil 17 to deflect the electron beams in the vertical and horizontal directions, and a shadow mask 18 which is located near a fluorescent screen are arranged in an envelope 14 of a high vacuum as shown in the diagram. Broken lines drawn from the deflecting coil 17 to the shield cup 16 indicate leakage magnetic fields.

Figure 6A:
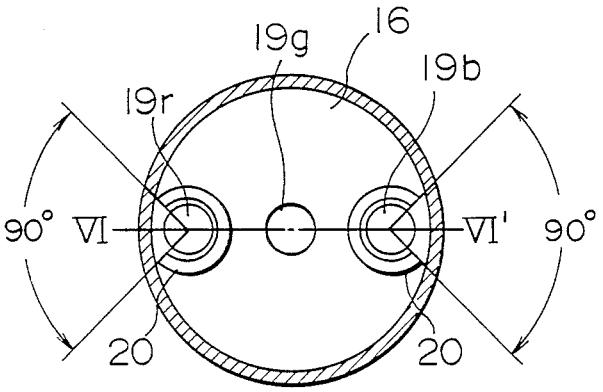
FIGS. 6A and 6B are diagrams showing attaching states in electron guns of magnetic material elements in the invention.
Figure 6B:
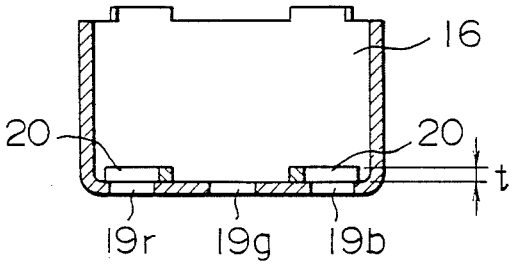

FIGS. 6A and 6B are diagrams showing the shield cup 16 of the electron guns according to the color picture tube in the embodiment of the invention. FIG. 6A is a plan view when the shield cup 16 is seen from the fluorescent screen side. FIG. 6B is a cross sectional view taken along the line VI—VI' in FIG. 6A. In the diagrams, the shield cup 16 is formed by molding a nonmagnetic material of a small thermal expansion coefficient, e.g., 42% Fe-Ni material by a press machining method, or the like. Further, a central electron beam through-hole **19*g* and outside electron beam through-holes 19*b* and 19*r* are formed in the inline direction at a predetermined distance in the bottom surface portion of the shield cup 16. In the peripheral portions of the outside electron beam through-holes 19b and 19r at both ends which are formed in the inside bottom surface of the shield cup 16, ring-shaped magnetic material elements 20 are fixed to the bottom surface of the shield cup 16 by a spot welding method. Each magnetic material element 20 is made of a material of a high relative permeability, e.g., an iron-nickel alloy consisting of 78% of Ni and 22% of Fe. A plate thickness t of each element 20 is set to 0.1 to 0.4 mm, preferably, about 0.2 to 0.3 mm. Each magnetic material element 20 has a gap portion of an opening angle of 90° on the side opposite to the central electron beam through-hole 19g. The gap portions of the through-holes 19r and 19b are formed so as to be symmetrical with respect to the central through-hole 19g as a center. The ring-shaped magnetic material element 20** is cut away by the amount of about 55 to 75% of a volume of a conventional ring-shaped element.

Figure 7:
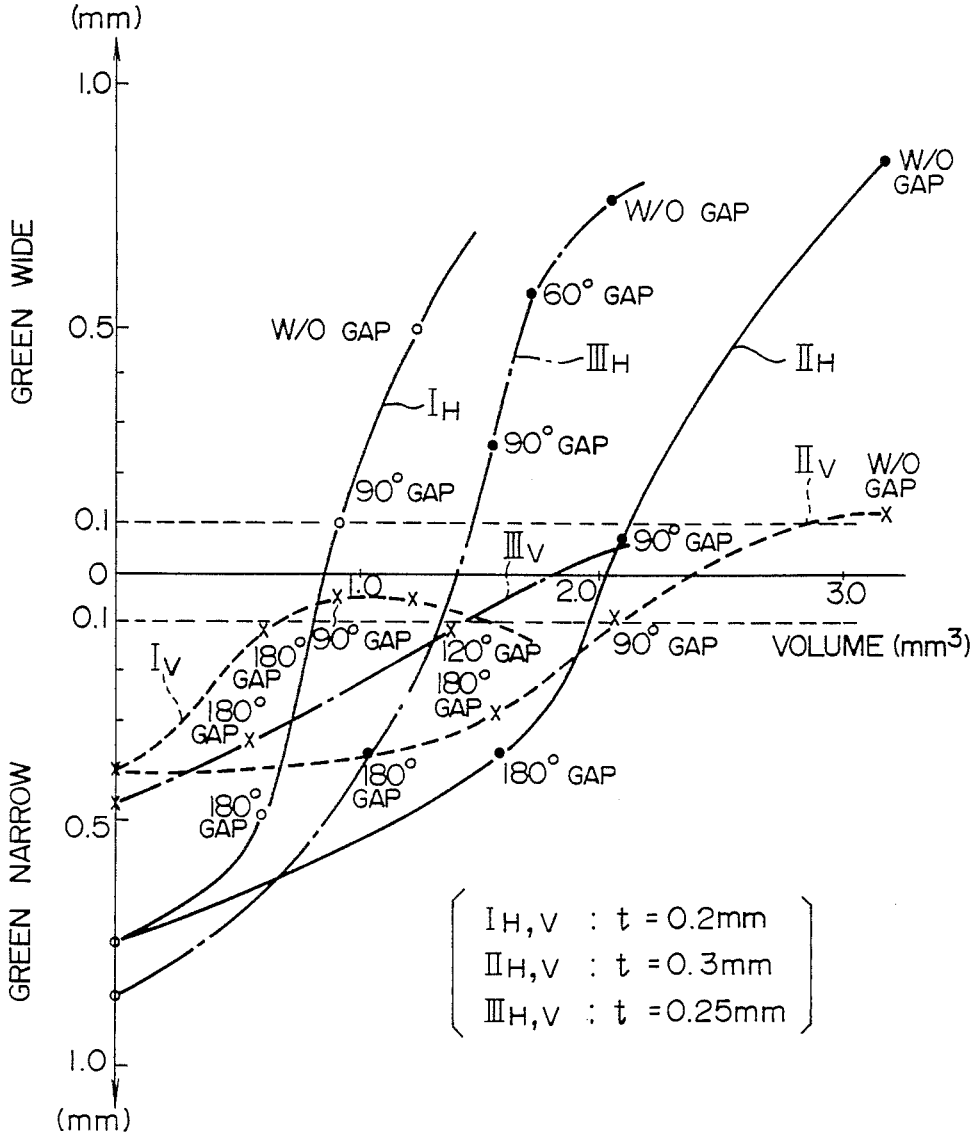
FIG. 7 is a characteristic diagram showing an effect of the magnetic material elements in the invention.

FIG. 7 shows the measured data of the relations among the green wide (W) and the green narrow (N) to the volumes of the ring-shaped magnetic material elements 20 having the electron beam through-holes in the case where these elements are arranged in the peripheral portions of the outside electron beam through-holes 19b and 19r. In FIG. 7, curves $I_H$ and $I_V$ indicate deflecting amounts in the horizontal and vertical directions when the thickness t of the plate is 0.2 mm. Curves $II_H$ and $II_V$ indicate deflecting amounts in the horizontal and vertical directions when the thickness t of the plate is 0.3 mm. Curves $III_H$ and $III_V$ represent deflecting amounts in the horizontal and vertical directions in the case of the magnetic material having an almost intermediate volume between the volumes in those two examples. As will be obvious from this diagram, when the ring-shaped flat plates having no gap portion were arranged in the peripheral portions of the electron beam through-holes 19r and 19b, the green wide in the vertical direction becomes the maximum. On the other hand, when gaps were formed in the inline direction at an angle of 180°, the green narrow in each of the vertical and horizontal directions increases. Therefore, in the embodiment, by using the arc-shaped magnetic material elements 20 in which the gap portions of an angle of 90°±10° are formed in the inline direction from the characteristics of FIG. 7, the deflecting magnetic fields of the outside electron beams are weakened and the deflecting magnetic field of the central electron beam is increased. The green wide and green narrow in both of the vertical and horizontal directions are corrected within ±0.1 mm and the coma distortions in the vertical and lateral directions can be minimized. A deviation within ±0.1 mm is a range which can be sufficiently corrected by the deflecting coil 17 arranged in a funnel portion of the image receiving tube and no problem occurs.

As described above, according to the invention, the arc-shaped magnetic material elements having gap portions of 90° are axially symmetrically and fixedly arranged in the peripheral portions of the outside electron beam through-holes formed in the bottom surface in the shield cup of the electron guns in a manner such that the gap portions face the outside. Therefore, the green raster, red raster, and blue raster are substantially made to coincide and the coma distortion can be minimized. Therefore, a color picture tube which hardly has a color deviation can be simply easily obtained.

What is claimed is:

1. A color picture tube including inline type electron guns and an electron beam electromagnetic deflecting apparatus, comprising:

a shield cup made of a nonmagnetic material which is attached to tips of said electron guns;

three electron beam through-holes formed in said shield cup and arranged in the incline direction; and annular magnetic material members which are arranged around the two outside electron beam through-holes among said three electron beam through-holes so as to be coaxial with said through-holes and to pass said electron beams, each of said magnetic material members being made of a material of a high permeability and serving as a shield of leakage magnetic fields from said electromagnetic deflecting apparatus, each of said two outside magnetic material members having a gap portion on the side opposite to the central electron beam through-hole, both of said gap portions having symmetrical shapes around said central electron beam through-hole as a center, and each of said gap portion of said annular magnetic material members having an opening angle of 90°±10° in the radial direction from the center of said member.

2. A color picture tube according to claim 1, wherein said annular magnetic material member consists of 78% of Ni and 22% of Fe.

3. A color picture tube according to claim 2, wherein a volume of said gap portion is equal to 55 to 75% of a volume of the annular magnetic material member before said gap portion is formed.

* * * * *